US005426350A

United States Patent [19]

Lai

[11] Patent Number: 5,426,350

[45] Date of Patent: Jun. 20, 1995

[54] HIGH FREQUENCY TRANSFORMERLESS ELECTRONICS BALLAST USING DOUBLE INDUCTOR-CAPACITOR RESONANT POWER CONVERSION FOR GAS DISCHARGE LAMPS

[75] Inventor: Jih-Sheng Lai, Knoxville, Tenn.

[73] Assignee: Electric Power Research Institute, Inc., Palo Alto, Calif.

[21] Appl. No.: 154,762

[22] Filed: Nov. 18, 1993

[51] Int. Cl.[6] ..... H05B 37/00

[52] U.S. Cl. ..... 315/244; 315/291; 315/307; 315/308; 315/209 R; 315/DIG. 2; 315/227 R

[58] Field of Search ..... 315/291, 219, 209 R, 315/244, 227, 307, 308, DIG. 2

[56] References Cited

U.S. PATENT DOCUMENTS

| | | | |
|---|---|---|---|
| 3,619,716 | 11/1971 | Spira et al. | 315/244 |
| 4,572,991 | 2/1986 | Coté | 315/240 |
| 4,818,918 | 4/1989 | Murphy | 315/244 |
| 4,859,914 | 8/1989 | Summa | 315/354 |
| 4,933,605 | 6/1990 | Quazi | 315/224 |
| 4,958,108 | 9/1990 | Jorgensen | 315/307 |
| 4,999,547 | 3/1991 | Ottenstein | 315/307 |
| 5,028,846 | 7/1991 | Lesea | 315/219 |
| 5,049,789 | 9/1991 | Kumar et al. | 315/289 |
| 5,051,665 | 9/1991 | Garrison | 315/287 |
| 5,057,752 | 10/1991 | Grabner et al. | 315/289 |
| 5,111,374 | 5/1992 | Lai | 363/37 |

OTHER PUBLICATIONS

Elenbaas W et al, "Lamp types and circuits", Fluorescent Lamps and Lighting, pp. 121–158, 1959, Macmillan, New York.

Licitra C et al, "Single-Ended Soft-Switching Electronic Ballast with Unity Power Factor", 1991 IEEE Industry Applications Society Annual Meeting, vol. I, No. 91CH3077-5.

*Primary Examiner*—Robert J. Pascal
*Assistant Examiner*—Reginald A. Ratliff
*Attorney, Agent, or Firm*—James W. Maccoun

[57] ABSTRACT

A novel high frequency LCLC double resonant electronic ballast has been developed for gas discharge lamp applications. The ballast consists of a half-bridge inverter which switches at zero voltage crossing and an LCLC resonant circuit which converts a low ac voltage to a high ac voltage. The LCLC resonant circuit has two LC stages. The first LC stage produces a high voltage before the lamp is ignited. The second LC stage limits lamp current with the circuit inductance after the lamp is ignited. In another embodiment a filament power supply is provided for soft start up and for dimming the lamp. The filament power supply is a secondary of the second resonant inductor.

14 Claims, 13 Drawing Sheets

VOLTAGE ACROSS THE LAMP

LAMP CURRENT

HIGH FREQUENCY TRANSFORMERLESS ELECTRONICS BALLAST USING DOUBLE INDUCTOR-CAPACITOR RESONANT POWER CONVERSION FOR GAS DISCHARGE LAMPS

BACKGROUND OF THE INVENTION

1. Field of Invention

This invention pertains generally to electronic ballasts for gas discharge lamps. More particularly, this invention relates to a novel Transformerless high frequency ballast.

2. Description of the Related Art

There are several types of conventional gas discharge lamps which have gained wide acceptance. These types include, for example, fluorescent, krypton, high intensity discharge, mercury vapor, metal halide, and sodium lamps.

Ballasts for gas discharge lamps serve several functions. Ballasts provide sufficient voltage to ignite the gas within the lamp in order to start the lamp. Ballasts provide a source for cathode heating to accelerate lamp start-up. Ballasts limit lamp current to prevent higher-pressure gases from destroying the lamp. As a last example, ballasts need to provide a unity power factor at the input side when the input is connected to utility alternating current ("ac") lines.

Typical gas discharge lamps require a high voltage to ionize the gas. After the gas is discharged, the lamp presents a negative impedance, and the lamp voltage maintains near constant. In order to provide a high voltage to ionize gases in a lamp, traditional ballasts use a transformer to boost the voltage. After the lamp is ignited, the transformer coil serves as an inductor to limit current. Traditional ballasts are also called "magnetic ballasts." These magnetic ballasts utilize iron-cores and magnet-wire coils for low frequency power systems.

Conventional electronic ballasts use a one stage LC resonant inverter to generate high frequency ac voltage for gas discharge lamps. A resonant T-type LCL circuit as shown in FIG. 1 is described in J. Funke, "Lamp Types and Circuits," in Fluorescent Lamps and Lighting, edited by W. Elenbaas et al, The MacMillan Co., New York, 1959. By applying an input voltage with a frequency near the first stage LC resonant frequency or ($f=\frac{1}{2}\pi\sqrt{L_1C}$), a high voltage will be generated across the second inductor.

Recently, high frequency electronic ballasts have been used to reduce the size of magnetic components and to improve lamp efficacy. When applying high frequency lamp currents, the arc will not extinguish at the zero crossings, thus high frequency lamp currents result in higher efficacy and in flicker elimination. Conventional electronic ballasts use transformers to produce high voltage and use additional inductors to limit the lamp current. Such ballasts consume large amounts of power, and the overall lamp-ballast efficiency improvement of such ballasts is limited by their inductors.

Typical gas-discharge lamps present a constant voltage across the lamp after the lamp is ignited. Their dimming control is accomplished by varying the lamp voltage or current which requires a feedback circuit, resulting in complicated and expensive control circuitry. The voltage or current control requires a feedback circuit for pulse width modulation. Such mechanism is expensive and not suitable for a universal ballast. Because the lamp voltage must be maintained constant after the lamp is ignited, the control mechanism needs to adjust the lamp current to vary the brightness. In traditional designs, the lamp start-up voltage is typically 100 percent higher than the steady-state voltage. This high start-up voltage causes filament sputters and causes reduced lamp life.

In order to maintain gas discharge, the filament needs to be heated. This filament heating helps lamp start-up but introduces additional losses. If the voltage across the lamp is high enough, the filament voltage can be removed after the lamp is ignited. However, the dimming capability will be lost with the removal of the filament voltage. Most existing electronic ballasts provide a fixed voltage across the filament.

Prior art inverter circuits have been proposed to ignite gas discharge lamp, in which the high voltage was generated by a transformer. Because the transformer does not limit the current after arc ionization, the circuit requires additional inductor in series with the lamp. The dimming control in these ballasts requires a feedback circuit to control the inverter duty cycle.

In addition to the shortcomings of conventional ballasts, conventional ballasts suffer from other limitations. Conventional ballasts produce iron noise (electromagnetic interference) due to their magnetizing branches; they have limited lamp life due to high startup voltage; they are heavy due to their low frequency transformer; they have limited power conversion efficiency due to core and coil losses.

SUMMARY OF THE INVENTION WITH OBJECTS

It is a general object of this invention to provide an improved ballast for gas discharge lamps which is transformerless and thus has an absence of a magnetizing branch and an absence of iron noise (electromagnetic interference).

It is another object of this invention to provide an improved ballast for gas discharge lamps which extends lamp life.

It is another object of this invention to provide an improved ballast for gas discharge lamps which is of low cost to manufacture.

It is another object of this invention to provide an improved ballast for gas discharge lamps which is of light weight.

It is still another object of this invention to provide an improved ballast for gas discharge lamps which has high power conversion efficiency.

It is still another object of this invention to provide an improved ballast for gas discharge lamps which has reduced flicker.

It is still another object of this invention to provide an improved ballast for gas discharge lamps which reduces start-up voltage requirements and thereby provides extended lamp life.

It is another object of this invention to provide an improved ballast having a control mechanism for adjusting the brightness of a gas discharge lamp.

These and other objects are accomplished by a novel high frequency LCLC double resonant electronic ballast. The invention includes a dc-to-ac inverter connected with an LCLC resonant circuit to provide a high voltage across the lamp before arc ignition and to limit the lamp current after arc ignition. The inverter switching frequency is tuned to the secondary LC resonant frequency. The inverter is in half-bridge configuration, as shown in FIG. 2. Because the switching frequency, i.e., resonant frequency of the second LC stage, is higher than the resonant frequency of the first LC stage, the inverter can be switched at zero voltages, and the overall inverter-LCLC ballast system efficiency can be very high due to lossless commutation. In another embodiment a filament power supply is provided for soft start up and for dimming the lamp. The filament power supply is a secondary of the second resonant inductor.

DETAILED DESCRIPTION OF THE PRESENT INVENTION

Fixed Brightness Embodiment

This embodiment is a ballast which has a half-bridge inverter that switches at zero voltage crossings and which has an LCLC resonant circuit. The LCLC resonant circuit has two LC stages. The first LC stage produces a high voltage. Inductance of the second LC stage limits lamp current after the lamp is ignited.

Figure 1:
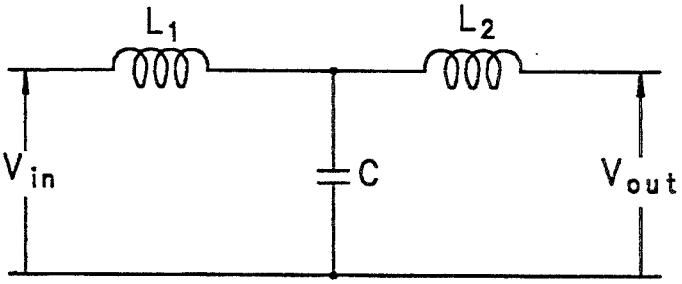
FIG. 1 is a conventional LCL resonant circuit for high output voltage generation.
Figure 2:
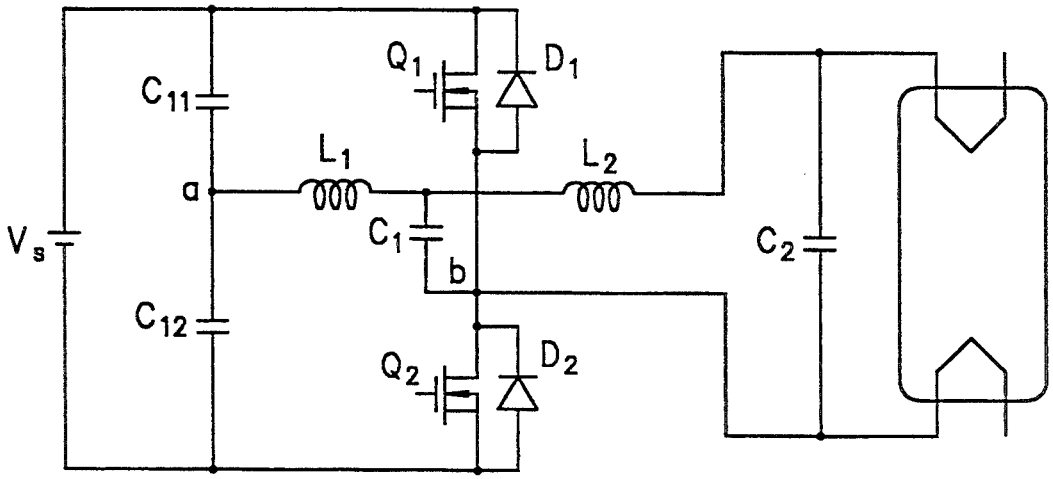
FIG. 2 is a schematic circuit diagram of the present invention.

This embodiment provides a novel high frequency transformerless double inductor-capacitor (LCLC) resonant power conversion circuit, as shown in FIG. 2. The present invention produces a high voltage at high lamp impedance and automatically limits current after the lamp is discharged. By matching LC values for both LC stages, a high voltage is generated at the secondary LC circuit. The lamp is connected across the secondary capacitor to obtain the required characteristics. The two-stage LCLC resonant circuit both eliminates the need for a high voltage transformer and serves the required ballast functions.

This embodiment uses an LCLC resonant inverter to produce not just high input frequency but also to produce high voltage ac sinusoidal voltage suitable for gas discharge lamps. The high voltage helps lamps start instantaneously, and is suitable for several lamps in series connection because only one high voltage resonant circuit is required for all lamps. This embodiment can thus reduce the ballast cost for series connected lamps. For a typical gas discharge lamp, the lamp impedance drops significantly after the lamp is ignited. This embodiment changes the voltage conversion ratio when the lamp impedance changes, and thus the circuit does not require extra current limiting components, resulting in cost saving and more efficient operation.

The LCLC resonant circuit was mathematically analyzed to show voltage amplification and current limiting features. The resonant circuit along with a high frequency dc-to-ac inverter was then simulated to show voltage and current characteristics. After proof of principle, several hardware circuits were built to test fluorescent lamps of different ratings. Experimental results show that the present invention performs well for fluorescent lamps.

In this embodiment as shown in FIG. 2, the input frequency is tuned to the second stage LC resonant frequency or ($f=\frac{1}{2}\pi\sqrt{L_2C_2}$). This input switching frequency is slightly higher than the first stage LC resonant frequency to ensure a zero-voltage switching condition on the semiconductor devices. Preferably, the input frequency is selected to be two to two and one-half percent higher in first stage LC resonant frequency.

The ballast is supplied by a dc voltage source $V_S$. The dc voltage source is rectified ac power or is battery power. The components of the ballast are a half-bridge inverter and an LCLC resonant circuit consisting of two LC stages.

The half-bridge inverter consists of capacitor $C_{f1}$ and $C_{f2}$, N-channel MOSFETs $Q_1$ and $Q_2$, diodes $D_1$ and $D_2$, and a controller (not shown). Capacitor $C_{f1}$ and capacitor $C_{f2}$, are connected in series and this series is connected in parallel across dc voltage source $V_S$ with $C_{f1}$ connected to the positive terminal of $V_S$ and with $C_{f2}$ connected to the negative terminal of $V_S$. Thus $C_{f1}$ and $C_{f2}$ provide a capacitive voltage divider. The connection between $C_{f1}$ and $C_{f2}$ also serves as a first input terminal a to the LCLC resonant circuit.

Figure 7:
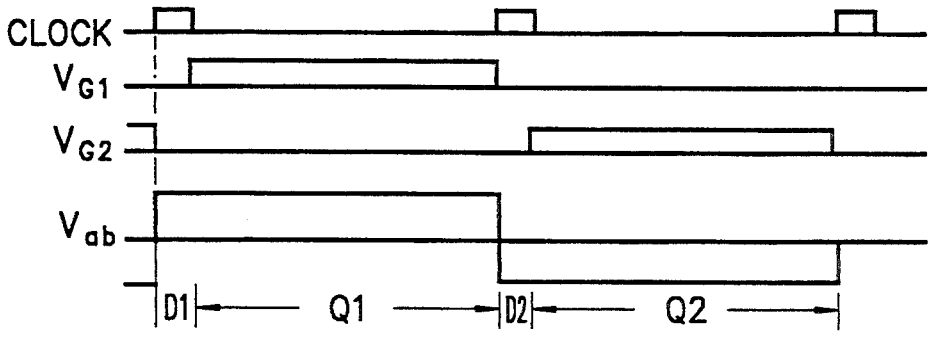
FIG. 7 shows waveforms of gate signals and the voltage at the input of the LCLC resonant circuit.
Figure 8A:
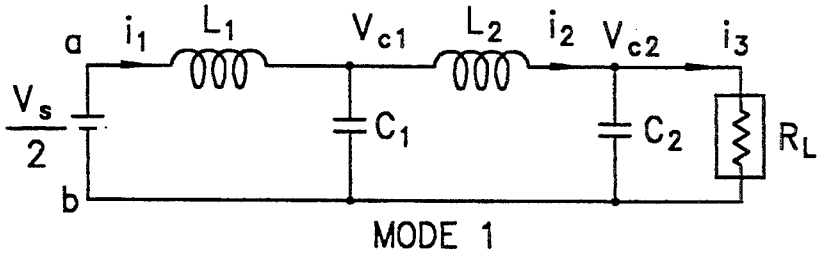
FIG. 8 are equivalent circuits for different operation modes.
Figure 8B:
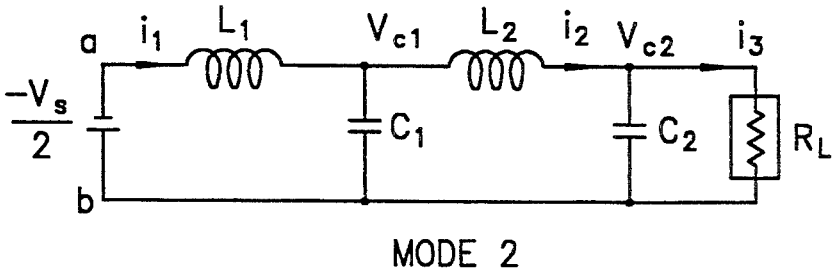

MOSFET $Q_1$ has its drain lead connected to the positive terminal of $V_S$ and has its source lead connected to the drain lead of MOSFET $Q_2$. The connection between $Q_1$ and $Q_2$ serves as a second input terminal b to the LCLC resonant circuit. $Q_2$ has its source lead connected to the negative terminal of $V_S$. $D_1$ has its anode connected to the source lead of $Q_1$ and has its cathode connected to the drain lead of $Q_1$. $D_2$ has its anode connected to the source lead of $Q_2$ and has its cathode connected to the drain lead of $Q_2$. $D_1$ and $D_2$, are free-wheeling diodes to steer feedback current back to the input. The controller is connected to the gate leads of $Q_1$ and $Q_2$. The controller provides voltages to the gate leads of $Q_1$ and $Q_2$ as shown in FIG. 7. Examples of suitable controllers are provided by Unitrode and Motorola and have the following part numbers respectively UC1825 and MC34025. The half-bridge inverter produces a high frequency (at frequency $f_1$) square wave input to the LCLC resonant circuit, that is, across input terminals a and b.

The LCLC resonant circuit has two LC stages. The first LC stage has a first inductor $L_1$ and a first capacitor $C_1$. A first lead of the first inductor $L_1$ is connected to the first input terminal a, and a second lead of the first inductor $L_1$ is connected to a first lead of the first capacitor $C_1$. A second lead of said first capacitor $C_1$ is connected to said second input terminal b.

The second LC stage has a second inductor $L_2$ and a second capacitor $C_2$. A first lead of the second inductor $L_2$ is connected to the first lead of first capacitor $C_1$. A second lead of the second inductor $L_2$ is connected to a first lead of the second capacitor $C_2$. A second lead of the second capacitor $C_2$ is connected to the second lead of the first capacitor $C_1$.

Power is delivered to a lamp by a connection from the first lead of the second capacitor to one filament of the lamp and by a connection from the second lead of the second capacitor to the other filament of the lamp. These connections are by means of a cable or by means of one or more additional lamps connected in series with the first lamp.

While the disclosure of the schematic diagram of FIG. 2 is believed to be sufficient for those skilled in the relevant art to make and use this embodiment, a number of the components and their values are identified for the convenience of those skilled in the art of the present invention.

TABLE I

| Reference Character | Description | Value |
|---|---|---|
| $C_{f1}$ | capacitor | 47 μF, 250 V |
| $C_{f2}$, | capacitor | 47 μF, 250 V |
| $Q_1$ | N-channel MOSFET | IRF 830 |
| $Q_2$, | N-channel MOSFET | IRF 830 |
| $D_1$ | diode | (body diode of $Q_1$) |
| $D_2$, | diode | (body diode of $Q_2$) |
| $L_1$ | inductor | 1.4 mH |
| $C_1$ | capacitor | 2,200 pF |
| $L_2$ | inductor | 4.4 mH |
| $C_2$ | capacitor | 680 pF |

Analysis of the LCLC Resonant Circuit

This embodiment was mathematically analyzed and simulated with computer programs. After the concept of this embodiment was proven, several prototype circuits were built for different rating fluorescent lamps. The prototype circuits worked successfully with fluorescent lamps. The following is an analysis of the theory of operation of the present invention.

In order to ionize the gas in the lamp, a high voltage is required from the ballast output. The principle of generating high voltage using the present invention can be understood by the analysis of the LCLC resonant circuit of FIG. 3.

Figure 3:
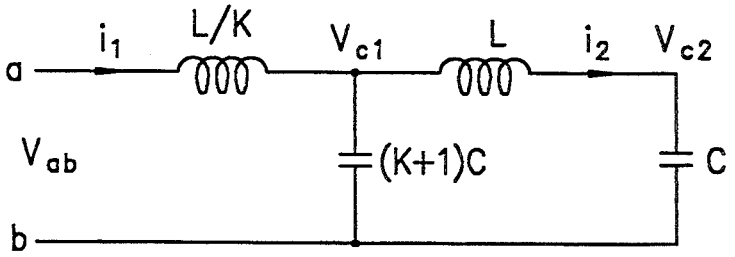
FIG. 3 is a special case LCLC resonant circuit for voltage amplification.

FIG. 3 is a special case of the LCLC resonant circuit, which has a unique feature that shows the amplification characteristic of the present invention. Consider a high frequency voltage $v_{ab}$ as the input to the LCLC resonant circuit. $v_{ab}$ has a fundamental frequency $\omega$, and can be expressed as $$v_{ab} = \sqrt{2}\ V_{ab}\sin\omega t$$

By tuning the input frequency to the secondary LC resonant frequency, i.e., $$\omega = \frac{1}{\sqrt{L_2C_2}}$$

the voltage amplification factor and equivalent impedance of the LCLC circuit in FIG. 3 can be calculated as $$\frac{V_{c2}}{V_{ab}} = -K$$

$$Z_{eq} = j\omega L_1$$

where $V_{c2}$ and $V_{ab}$ are root mean square voltages across $C_2$ and the input terminals a and b, respectively. The equation explains that by inputting a sinusoidal voltage, the output voltage can be amplified K times with 180° phase shift. The non-zero impedance also explains that the lamp current can be limited.

For different input frequencies, the circuit impedance varies over the entire frequency range. Incorporating lamp resistance, $R_L$, the equivalent circuit impedance, $Z_{eq}$, as a function of frequency can be expressed as the following equation.

$$Z_{eq} = \frac{N}{D}$$

where $$N = R_L + \omega^2(\omega^2 L_1L_2C_1C_2 - L_1C_1 - L_1C_2)$$
$$R_L + j\omega(L_1 + L_2 - \omega^2 L_2C_1)$$
$$D = 1 - \omega^2 L_2C_1 + j\omega(C_1 + C_2 - \omega^2 L_2C_1C_2)R_L$$

Figure 4A:
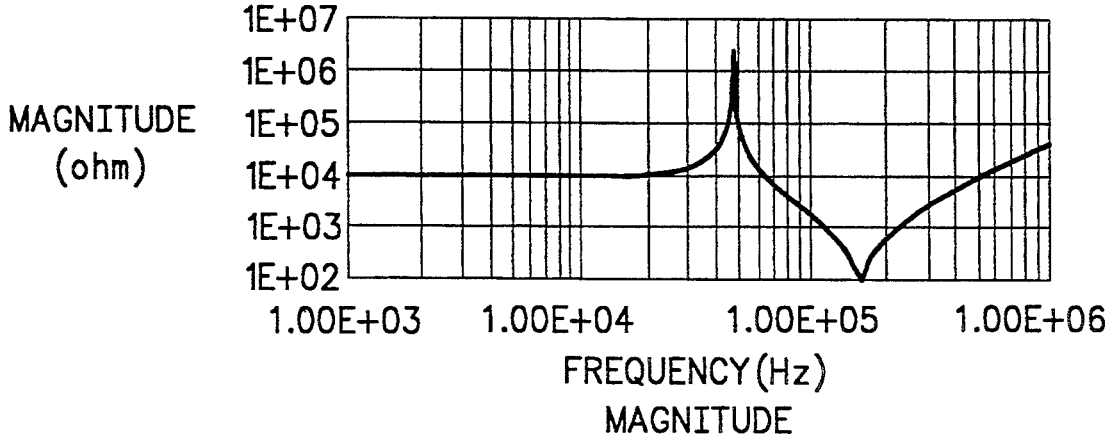
FIG. 4 is a chart of magnitude and angle of the equivalent impedance frequency responses.
Figure 4B:
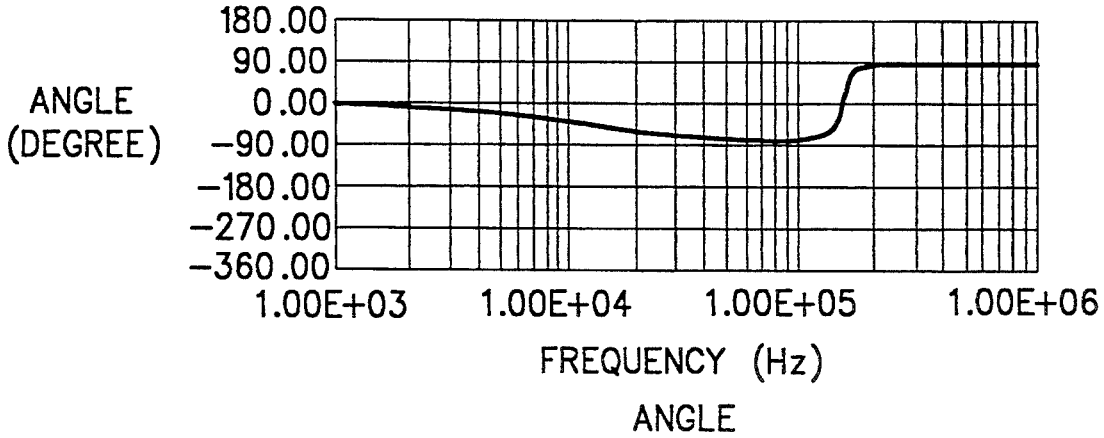
Figure 5A:
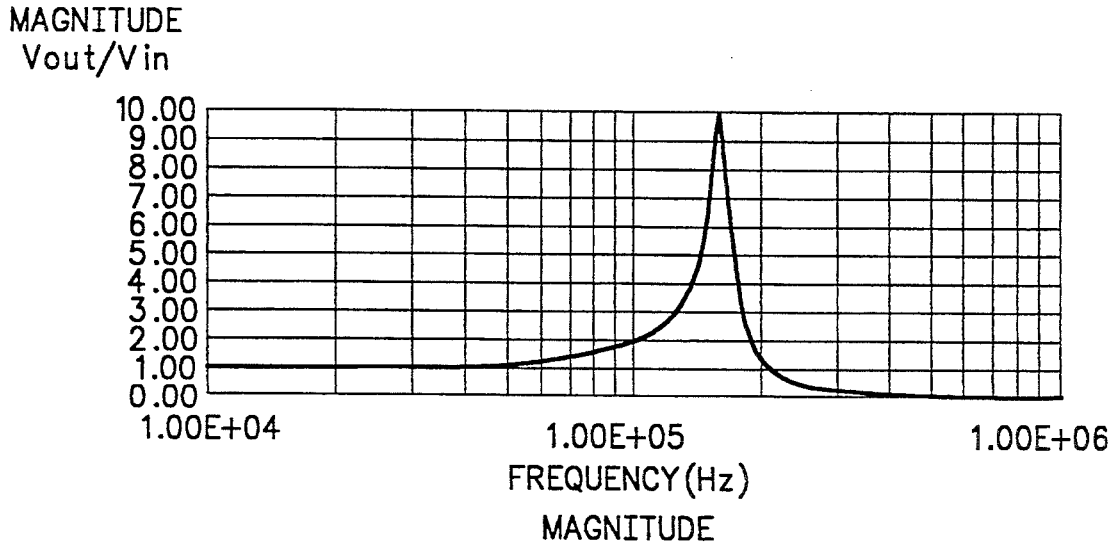
FIG. 5 is a chart of magnitude and angle of the voltage conversion ratio as functions of the switching frequency.
Figure 5B:
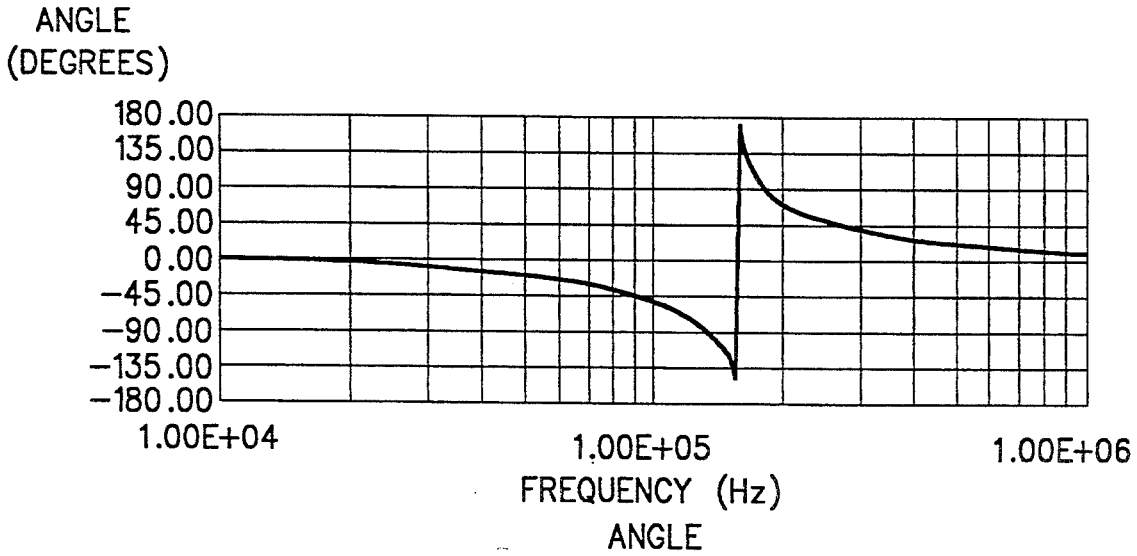

Given circuit parameters as $L_1 = 1$ mH, $L_2 = 10$ mH, $C_1 = 1100$ pF, $C_2 = 100$ pF, and $R_L = 10{,}000\ \Omega$, the frequency responses of the equivalent impedance $Z_{eq}$ can be shown in FIG. 4. At the resonant frequency, the magnitude of $Z_{eq}$, shown in FIG. 4(*a*), reduces to a minimum but non-zero so as to limit the lamp current. The above impedance can be used to calculate the voltage conversion ratio. FIG. 5 shows the magnitude and phase angle of the voltage conversion ratio as functions of frequencies. As indicated in the figure, the maximum voltage conversion ratio is 10 and occurs at 159.2 kHz.

Figure 6:
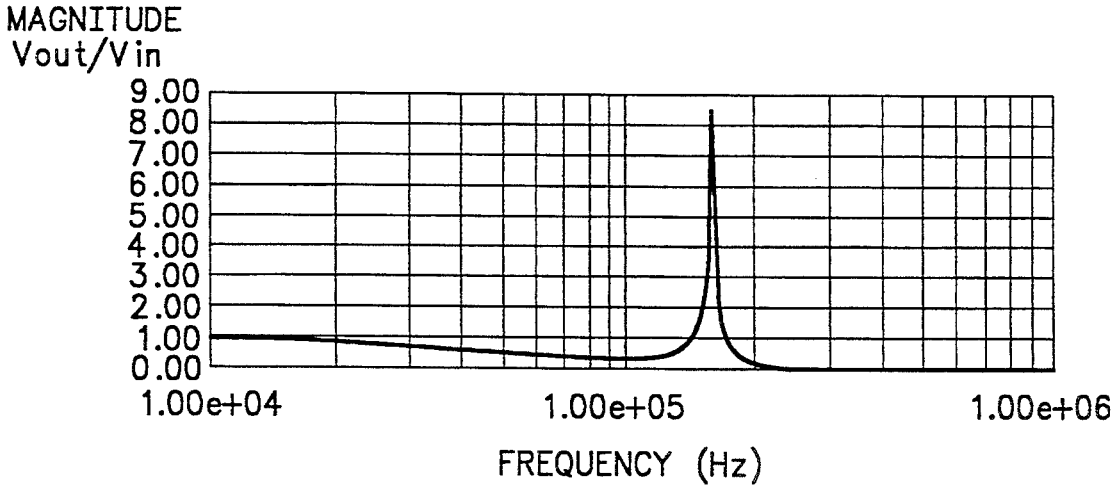
FIG. 6 is the voltage conversion ratio as a function of frequency when the lamp resistance is reduced.

The lamp impedance reduces when the lamp is ignited. For the case that the impedance is reduced from 10,000 Ω to 2,000 Ω, the voltage conversion ratio will be reduced, as shown in FIG. 6. The switching frequency does not necessarily operate at the highest voltage conversion frequency, which may result in overvoltage damage and non-zero voltage switching. In actual implementation, the switching frequency of the present invention shifted a little higher to obtain the required voltage for the lamp. This frequency shift is approximately 1 to 10 kHz when the second LC stage resonant frequency is 159.2 kHz.

For a half-bridge based inverter driven ballast circuit, shown in FIG. 2, the switching sequence is shown in FIG. 7. Half of the source voltage, $V_S$, is directly applied to the input terminals a and b. Instead of inputting sinusoidal voltage into the LCLC circuit, the supply voltage $v_{ab}$ is a square wave. The square wave voltage contains the fundamental component and high frequency odd harmonics, i.e., 3rd, 5th, 7th, etc. However, the characteristic shown in FIGS. 5 and 6 indicates that the high frequency harmonics are attenuated, and the output voltage at the lamp side is sinusoidal with a frequency equal to the switching frequency. Zero-voltage switching can be achieved when the switching frequency is higher than the resonant frequency of the first stage LC resonant circuit ($L_1$ $C_1$), i.e., $$\omega = \frac{1}{\sqrt{L_1 C_1}}$$

With a switching pattern shown in FIG. 7, dynamic equations of the resonant LCLC ballast incorporating a lamp resistance can be described as below.

$$\frac{di_1}{dt} = \frac{V_{ab} - V_{c1}}{L_1}$$

$$\frac{di_2}{dt} = \frac{V_{c1} - V_{c2}}{L_2}$$

$$\frac{dV_{c1}}{dt} = \frac{i_1 - i_2}{L_1}$$

$$\frac{dV_{c2}}{dt} = \frac{i_2 - i_3}{L_2}$$

$$i_e = \frac{V_{c2}}{R_L}$$

$$V_{ab} = V_s/2 \text{ at Mode 1}$$
$$= -V_s/2 \text{ at Mode 2}$$

These dynamic equations were simulated using PC SIMNON, a computer program, to verify the circuit operation. In simulation modeling, the lamp impedance was considered to have difference values of resistance before and after start up. An experimental circuit was then built based on the simulation parameters.

Figure 9A:
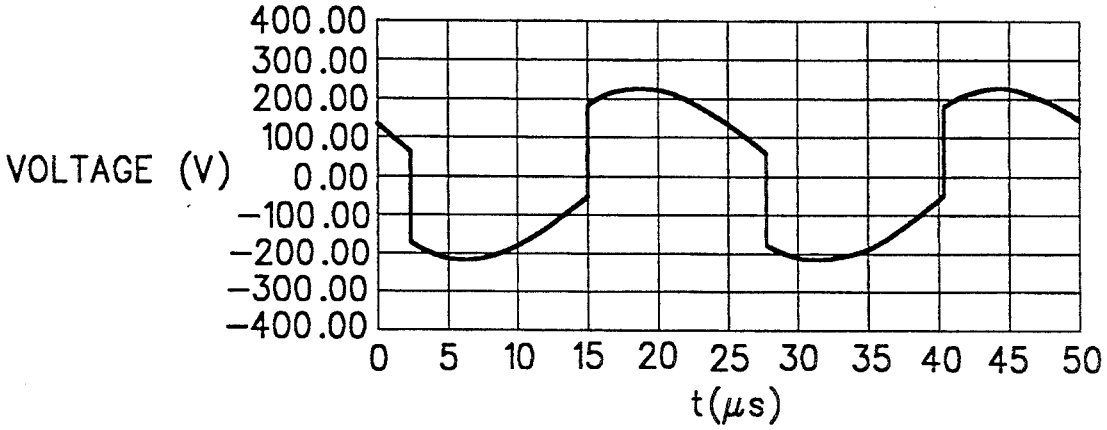
FIG. 9 are the voltage across the inductor $L_1$, and the current flowing in the inductor $L_1$.
Figure 9B:
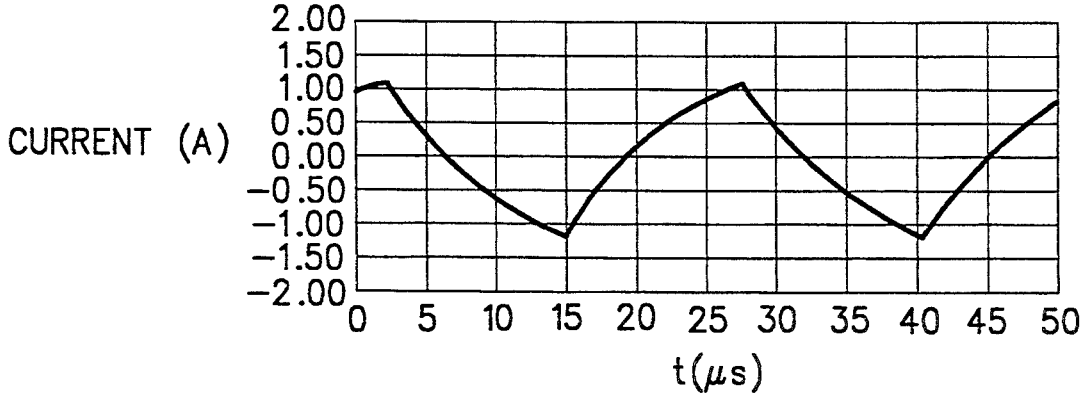

FIG. 9 shows the experimental voltage across the inductor $L_1$ and current flowing in the inductor $L_1$. The current increases when a positive voltage is applied and decreases when a negative voltage is applied. The net energy from the inductor charging and discharging is near zero. The power devices are switching at zero voltages, resulting a near lossless operation.

Figure 10A:
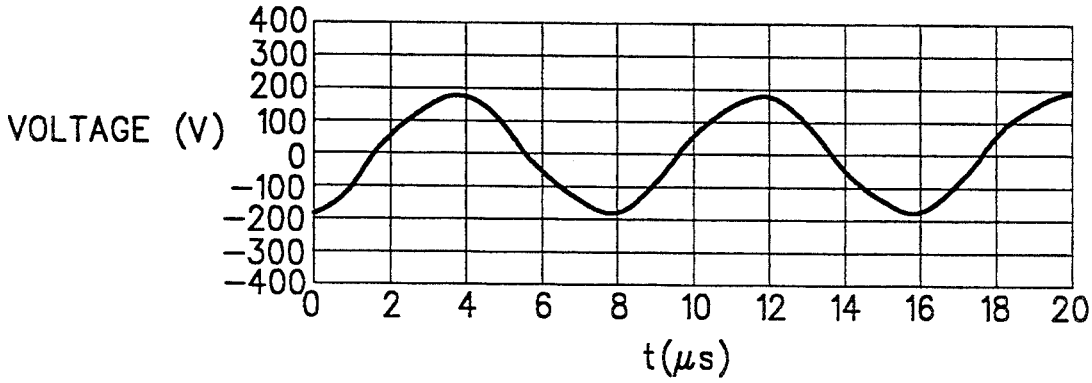
FIG. 10 (*a* and 10*b*)are the voltage across the lamp and the current flowing in the lamp after the lamp is ignited.
Figure 10B:
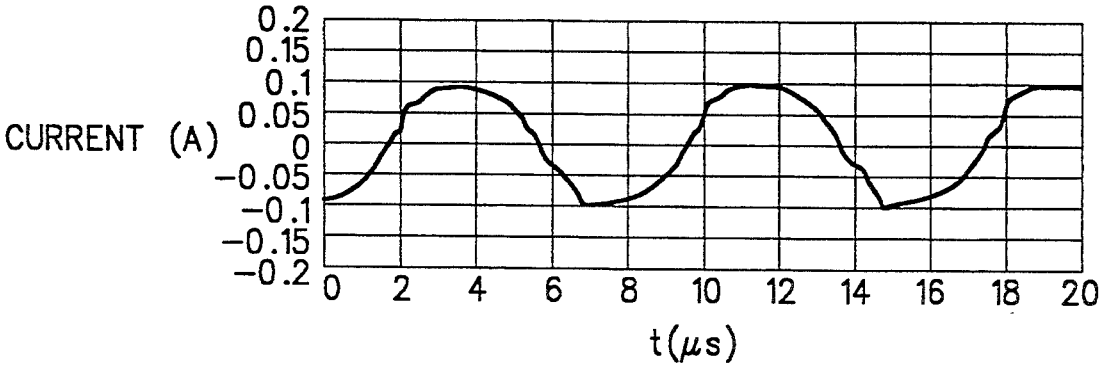

FIG. 10 shows the experimental voltage across the lamp and current flowing in the lamp for two 20-W lamps in series condition. Both voltage and current are near sinusoidal except at the gas discharge points where the current rise rate is higher. These high frequency voltage and current waveforms generated by the present invention are, however, much smoother than the results from conventional magnetic ballasts. Compared to conventional ballasts, the present invention is also improved because there are no glitches in the lamp current and voltage supplied by the present invention.

The clean voltage and current waveforms indicate that there is no electromagnetic interference (EMI) generated in the power system. The radiated EMI is also negligible as indicated by a radio near the lamp which radio did not pick up any noise.

Figure 11:
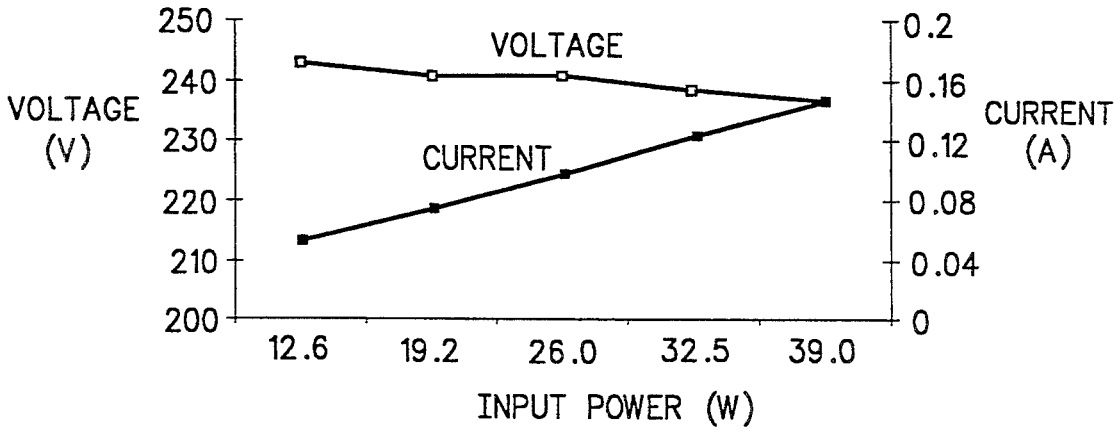
FIG. 11 are the voltage and current as functions of the input power for two 40-W lamps in series condition.

FIG. 11 shows the dimming capability of the circuit with the control of the dc input voltage $V_S$. In this experiment, two 40-W lamps were in series, and the input voltage $V_S$ was adjusted to obtain different output. For different brightness, the lamp voltage, shown in rms value, was maintained near constant, while the lamp current, also shown in rms value, is varied to provide different brightness.

Figure 12:
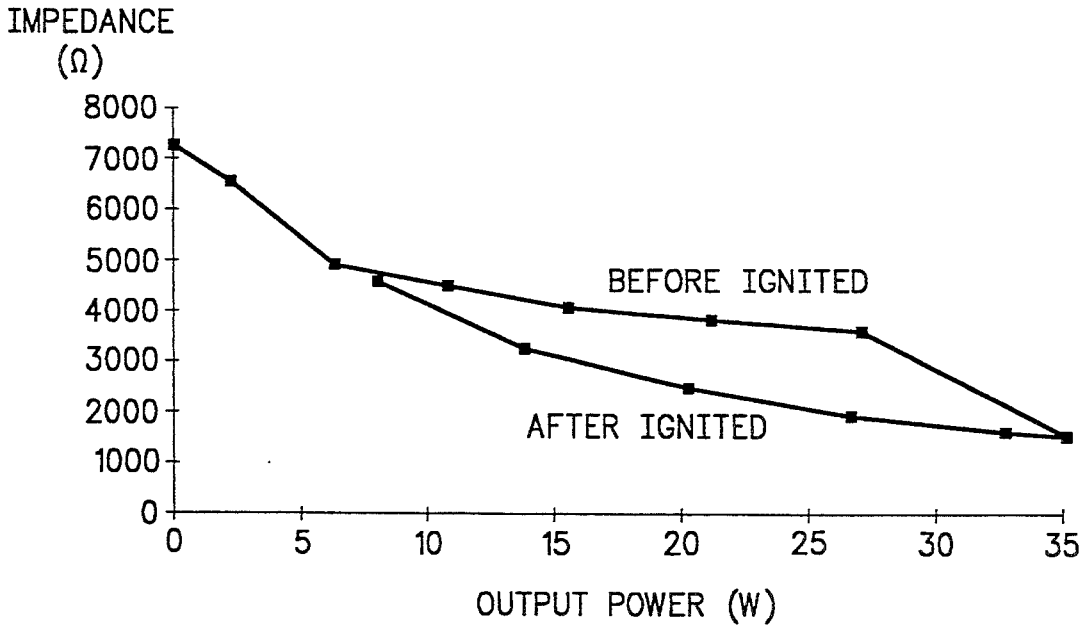
FIG. 12 are the lamp impedance and the output power as functions of the input power for two 40-W lamps in series condition.

FIG. 12 shows the lamp impedance and resonant circuit output power as functions of the dc input power. The efficiency of the resonant circuit can be derived from the chart. The efficiency for different output brightness ranges from 85% to 90%. Total power losses consist of power device conduction loss and inductor copper and iron losses.

Soft-Start Dimmable Embodiment

In another embodiment of the present invention, the capability is provided for dimming the lamp described in the above embodiment. By varying switching frequency, the voltage amplification ratio and characteristic impedance of the LCLC resonant circuit described above will automatically adjust to provide the dimming control. A feedback loop is not required in this frequency control method. This dimming controlled ballast circuit also provides filament heating which can reduce the lamp start-up voltage requirement, and thus extend lamp life. This soft-start characteristic is effective under both full brightness and dimming conditions. Although the filament adds more power consumption, the circuit of this embodiment remains high frequency by providing a higher filament voltage to help start-up and a lower filament voltage after the gas is discharged. The filament voltage also helps dimmability control.

In this embodiment, the lamp start-up voltage is only 30 percent higher than the steady-state voltage. This low start-up voltage can reduce the filament sputters and significantly increase the lamp life. This embodiment also provides dimming function by variable frequency control. By slightly mismatching the switching frequency with the resonant circuit frequency, the lamp output can be controlled in dimming conditions.

This embodiment provides a variable filament voltage with a high preheat voltage during start-up but a low steady-state voltage to improve the efficiency. This embodiment can produce high voltage without a high voltage transformer and inherently limit the lamp current with the circuit inductance after the lamp is ignited. The filament voltage is derived from the second resonant inductor in a variable amplitude format. The dimming control does not require any feedback circuit.

The basic idea of this LCLC circuit is to provide variable voltage amplification ratios under different lamp impedance conditions. The approach of this embodiment is to add filament voltages and a variable frequency control circuit for dimming control. A variable filament voltage which has higher voltage at the start-up to help accelerating gas ionization and a lower voltage at the steady state to avoid high filament losses. The dimming control is obtained by varying the switching frequency to change the voltage amplification ratio, and thus controlling the lamp output current.

Figure 13:
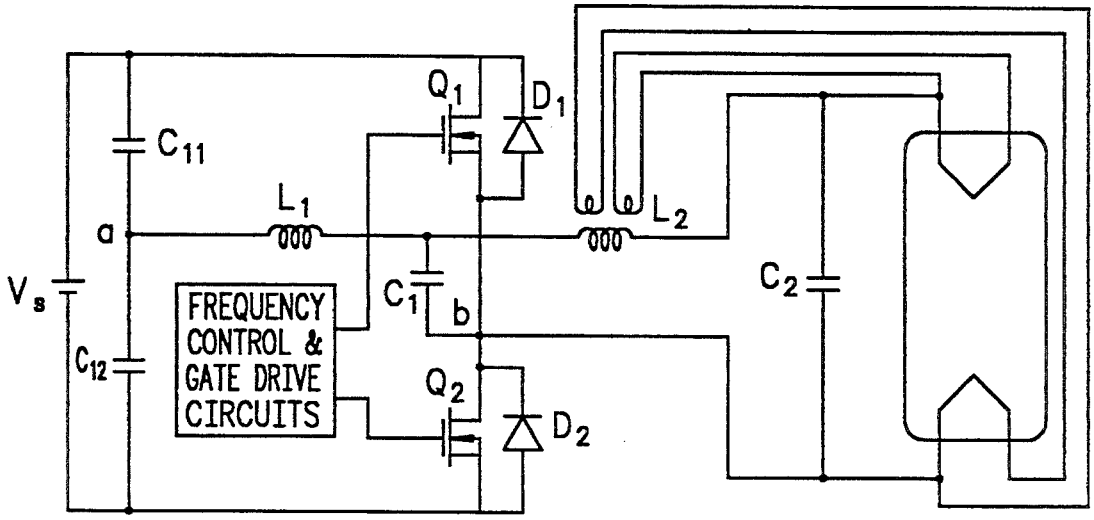
FIG. 13 is a schematic circuit diagram of the recommended soft-start and dimming control for a high frequency LCLC resonant ballast circuit using a half bridge inverter for zero voltage switching.

This embodiment includes a filament power supply circuit and a frequency control method for soft-start and dimming control. The novel filament power supply is proposed to be added at the secondary of the second resonant inductor. FIG. 13 illustrates the proposed soft-start and dimming control circuit. Before the lamp is ignited, the resonant inductor voltage is higher than the steady-state inductor voltage. The same condition can also be applied to the filament voltage. A higher start-up filament voltage can help accelerate gas ionization, while a lower steady-state voltage can reduce the power consumption. The dimming control can be obtained by varying the switching frequency to change the voltage amplification ratio, and thus controlling the lamp output current. The filament power supply along with the frequency control provides soft-start characteristic and dimming operation.

The basic LCLC circuit presents a high voltage amplification factor at the second set of the inductor and capacitor when the lamp resistance is high or before the lamp is ignited. After the lamp is ignited, the ionized gases cause a low lamp resistance, and thus reduce the voltage amplification factor of the LCLC circuit. Based on this variable voltage amplification factor characteristic, the filament voltage can also be varied by utilization of the second inductor voltage. As shown in FIG. 13, the method is to utilize the inductor, $L_2$, as a transformer to provide the filament a variable voltage before and after gas discharges. From circuit point of view, the addition of the filament at the secondary of the inductor, $L_2$, is equivalent to series connecting a small amount of resistance into the LCLC resonant circuit. This resistance only introduces a damping effect but does not affect the voltage amplification of the basic LCLC resonant circuit.

Figure 14:
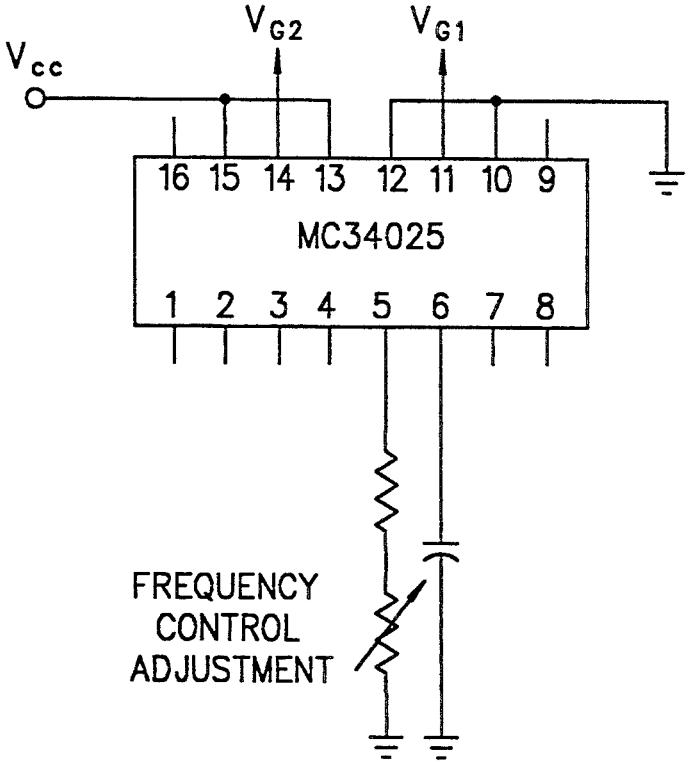
FIG. 14 is a part of the frequency control integrated circuit.

In order to ionize the gas in the lamp, a high voltage is required from the ballast output. The half-bridge inverter consists of two energy storage capacitors, $C_{f1}$ and $C_{f2}$, and two switching device pairs, $Q_1-D_1$ and $Q_2-D_2$. The source voltage $V_s$, is equally divided by two halves for the two energy storage capacitors, $C_{f1}$ and $C_{f2}$. By controlling the switching devices, $Q_1$ and $Q_2$, in a sequence, shown in FIG. 7, the voltage across a and b, $V_{ab}$, becomes an alternative square wave. The voltages applied to the gates, $V_{G1}$ and $V_{G2}$, are operating sequentially with a short dead time that allows the resonant circuit current diverting through the anti-paralleled diodes, $D_1$ and $D_2$. FIG. 14 shows a part of the frequency control circuit. An integrated circuit, MC34025, is used as an example hardware design for frequency control and gate drivers.

Figure 15:
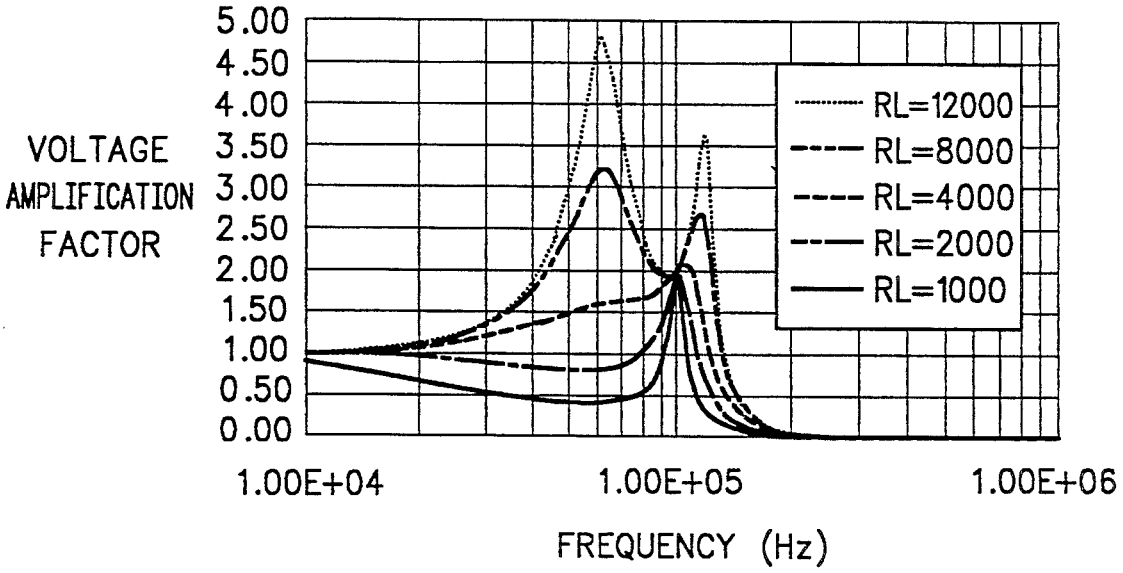
FIG. 15 is the voltage amplification ratio as a function of frequency when the lamp resistance is varied.
Figure 16A:
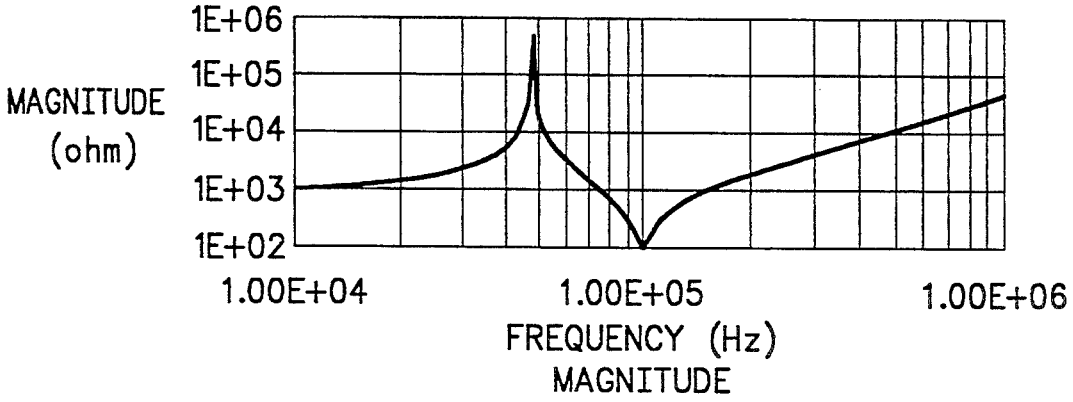
FIG. 16*a* and 16*b* are magnitude and angle of the equivalent impedance frequency responses.
Figure 16B:
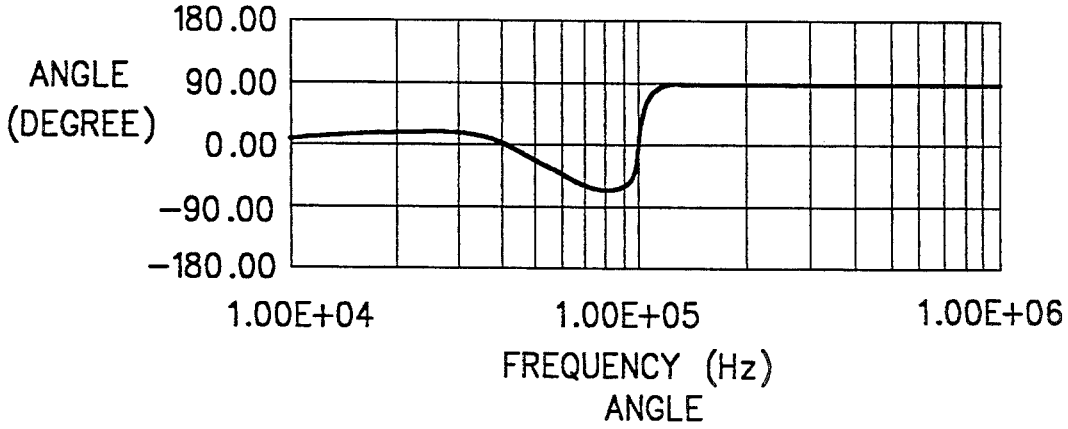

The resonant circuit consists of two pairs of inductor-capacitor (LC), $L_1-C_1$ and $L_2-C_2$. The lamp presents different impedance before and after start-up. For different lamp resistances, the voltage amplification factors as functions of the operation frequency are shown in FIG. 15. At the circuit resonant frequency (near 100 kHz in FIG. 15), the voltage amplification factor is about the same for different lamp resistances. When the operation frequency is slightly shifted off the resonant frequency, the voltage amplification factor varies for different lamp resistances. The resonant circuit impedance, shown in FIG. 16 is also a function of the operation frequency. The characteristic of variable voltage amplification factor and resonant circuit impedance as functions of the operation frequency can be used for soft-start and dimming control.

The voltage amplification factor, A, is defined as $$A = \frac{V_L}{V_{ab}}$$

where $V_L$ is the voltage across the lamp. Should we assume the lamp impedance is RL, then the voltage amplification factor as a function of frequency can be derived as shown below.

$$A = \frac{R_L}{\sqrt{(R_L - \omega^2 R_L(L_1C_1 + L_1C_2 + L_2C_2) + \omega^4 L_1L_2C_1C_2)^2 + \omega^2(L_1 + L_2 - \omega^2 L_1L_2C_1)^2}}$$

The angular frequency, $\omega$, in the above equation is defined as $\omega=2\pi f$, where $f$ is the inverter operation frequency. The lamp impedance reduces when it is ignited. For the cases that the impedance varies from 10,000 Ω to 2,000 $\omega$, the voltage amplification ratios as functions of the operation frequency are shown in FIG. 15.

The circuit impedance also varies over the entire frequency range. With incorporating lamp resistance, $R_L$ the equivalent circuit impedance, $Z_{eq}$ as a function of frequency can be expressed as the following equation.

$$Z_{eq} = \frac{N}{D}$$

where $$N=R_L+\omega^2(\omega^2L_1L_2C_1C_2-L_1C_1-L_1C_2)$$
$$R_L+j\omega(L_1+L_2-\omega^2L_2C_1)$$
$$D=1-\omega^2L_2C_1+j\omega(C_1+C_2-\omega^2L_2C_1C_2)R_L$$

Given circuit parameters as $L_1=1.5$ mH, $L_2=5$ mH, $C_1=2200$ pF, $C_2=680$ pF, and $R_L=10{,}000$ Ω, the frequency responses of the equivalent impedance $Z_{eq}$ can be shown in FIG. 16. At the resonant frequency, the magnitude of $Z_{eq}$ shown in FIG. 16(*a*), reduces to minimum, and the angle of $Z_{eq}$ shown in FIG. 16(*b*), is zero. The equivalent impedance, $Z_{eq}$ becomes more inductive when the frequency increases. This indicates that zero-voltage switching can be switched when the switching frequency is higher than the resonant frequency.

Experimental Results

Figure 17:
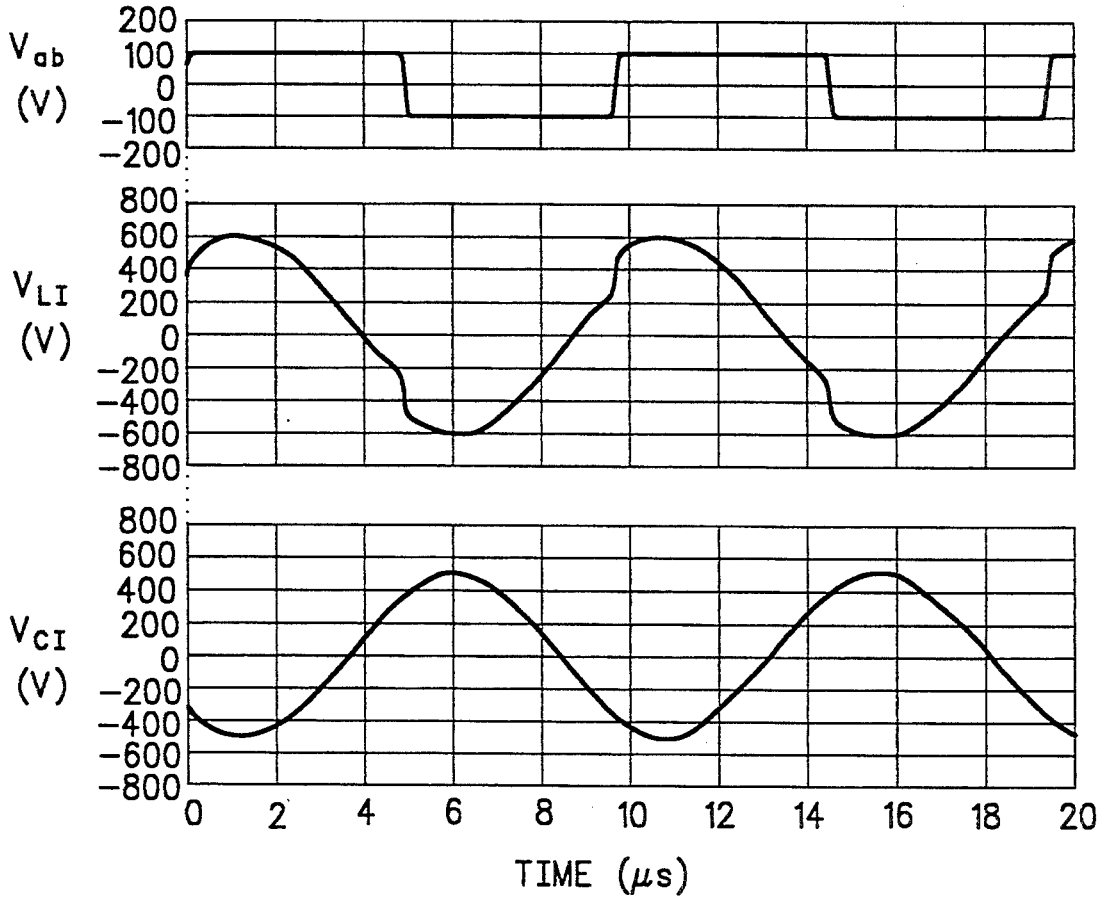
FIG. 17 are voltages across a and b points, $V_{ab}$, the first resonant inductor, $V_{L1}$, and the first resonant capacitor, $V_{C1}$.

FIG. 17 shows the experimental voltages $V_{ab}$, $V_{L1}$, and $V_{C1}$ where $V_{ab}$, represents the voltage across a and b, $V_{L1}$ represents the voltage across the inductor $L_1$, and $V_{C1}$ represents the voltage across the capacitor $C_1$. The power devices are switching at zero voltages, resulting a near lossless operation.

Figure 18:
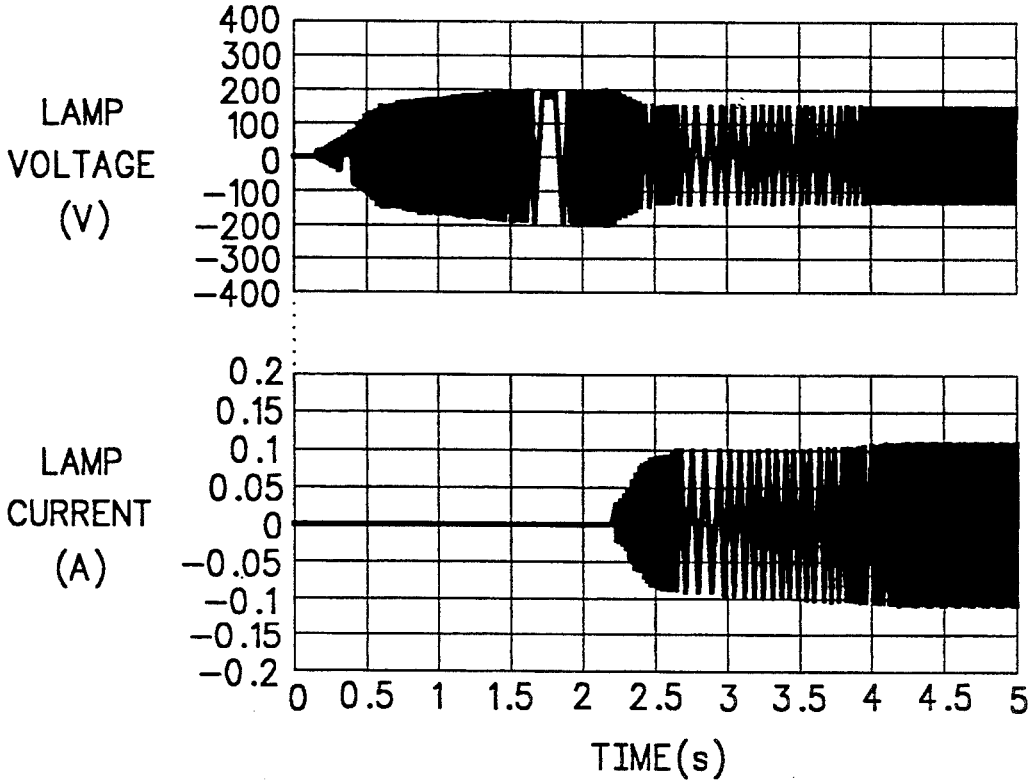
FIG. 18 are the lamp voltage and current during start-up.
Figure 19:
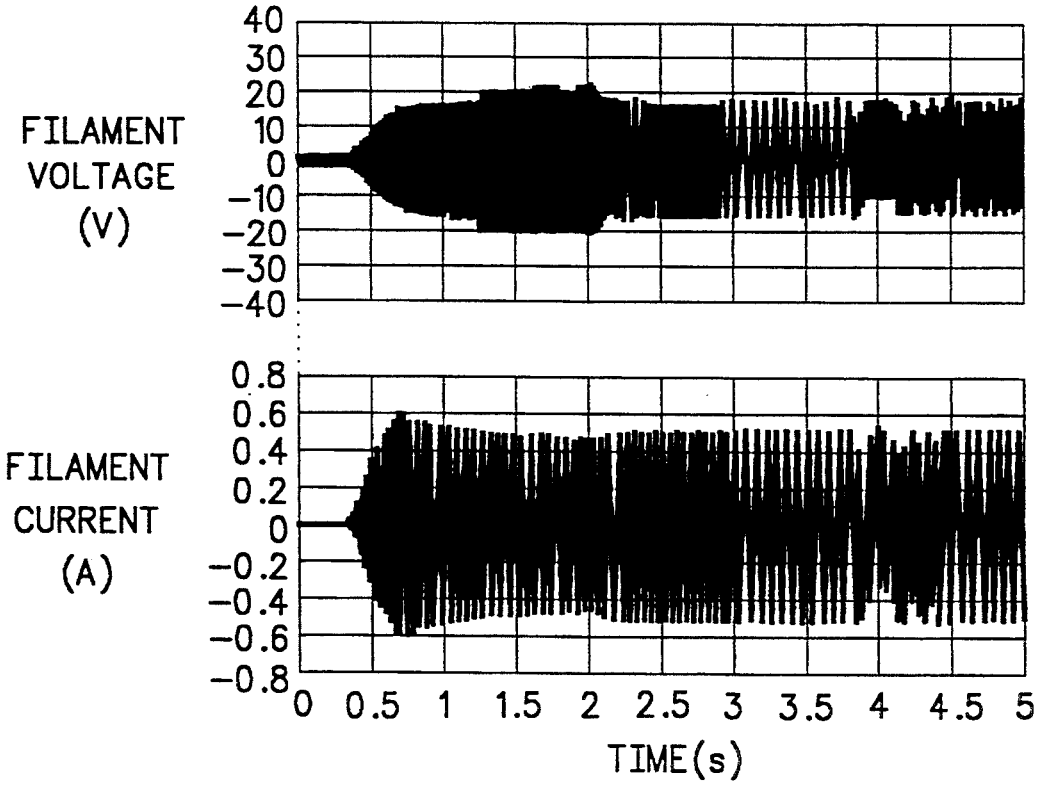
FIG. 19 are the filament voltage and current during start-up.

FIGS. 18 and 19 illustrate the start-up conditions. The total start-up time is about two seconds. Before the lamp current reaches the steady-state condition, the lamp voltage is about 30% higher than its steady-state condition. The filament voltage is proportional to the lamp voltage to accelerate the start-up. Comparing to the traditional ballast with twice start-up voltage, the proposed design can significantly reduce sputters and extend the lamp life.

Figure 20:
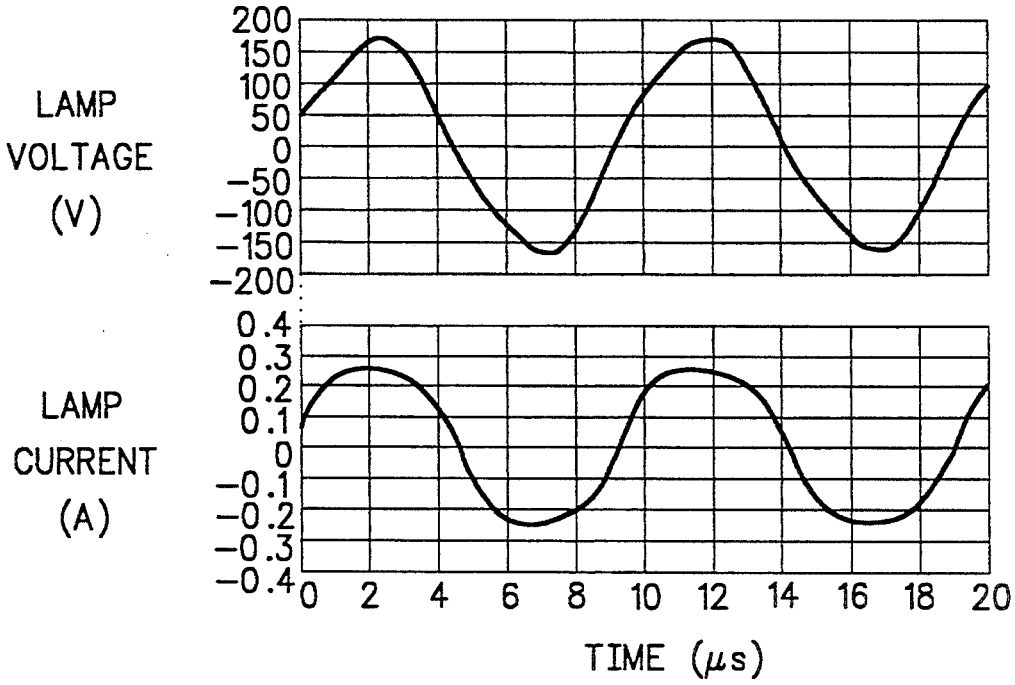
FIG. 20 are the steady-state voltage across the lamp and current flowing when the inverter is operating at 99 kHz.

FIG. 20 shows the experimental voltage across the lamp and current flowing in the lamp for two 20-W lamps in series connection. The operation frequency was 99 kHz, and the lamp was operating at full brightness. Both voltage and current are near sinusoidal except at the gas discharge points where the current rise rate is higher. These high frequency voltage and current waveforms generated by the proposed circuit are, however, much smoother than the results from the traditional magnetic ballasts. The clean voltage and current waveforms indicate that there is no electromagnetic interference (EMI) generated in the power system.

Figure 21:
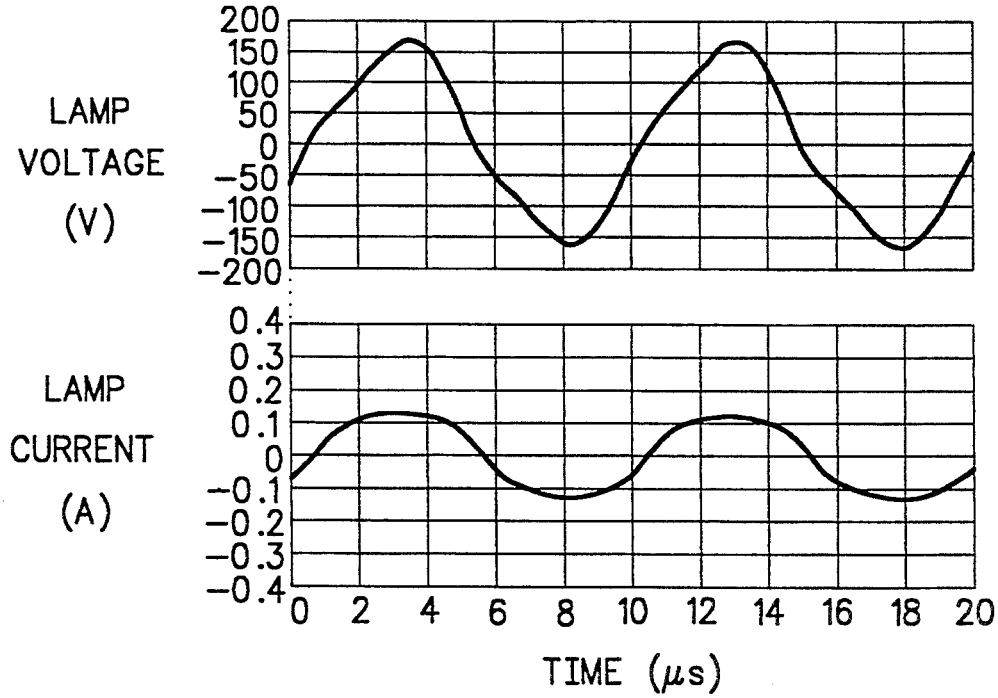
FIG. 21 are the steady-state voltage across the lamp and current flowing when the inverter is operating at 102 kHz.

When the operation frequency is increased, the lamp current reduces, and the lamp is operating under dimming condition. FIG. 21 shows the 102 kHz switching operation. Notice that for different brightness, the lamp voltage was maintained near constant, while the lamp current varies with different brightness. This dimming operation can be understood by looking at FIGS. 15 and 16. FIG. 15 shows that for an 1000-Ω lamp resistance, the voltage amplification factor is maximum when the frequency is 96 kHz. When the frequency is increased, the voltage amplification factor reduces. FIG. 16 shows that the equivalent impedance is lowest when the frequency is at the resonant frequency (100 kHz). When the frequency is increased, the equivalent impedance is increased, or the lamp current will be reduced.

Experimental results have shown that the present invention circuit performs well for fluorescent lamps. Several ratings, including 40 W 20 W, and 15 W, of fluorescent lamps and their series combinations have been tested successfully with the present invention. The present invention is also applicable to other gas discharge lamps, such as krypton lamps, high intensity discharge lamps, mercury vapor lamps, metal halide lamps, sodium lamps, with an appropriate modification of the voltage ratio. The advantages seen in the fluorescent lamp application will also be seen in other gas discharge lamps.

Persons skilled in the art of the present invention may, upon exposure to the teachings herein, conceive other variations. Such variations are deemed to be encompassed by the disclosure, the invention being limited only by the appended claims.

I claim:

1. A gas discharge lamp ballast comprising:

a. means for supplying a dc supply voltage $V_s$;

b. means for inverting said dc supply voltage $V_s$ to produce an input voltage $V_{ab}$ having a high frequency ac waveform across a first input terminal a and a second input terminal b, said input voltage having a switching frequency $f_s$;

c. a circuit having a first LC stage having a first resonant frequency $f_1$ and a second LC stage having a second resonant frequency $f_2$ said second frequency $f_2$ selected to be higher than said first frequency $f_1$;

said first LC stage having a first inductor and a first capacitor, a first lead of said first inductor connected to said first input terminal a, a second lead of said first inductor connected to a first lead of said first capacitor, and a second lead of said first capacitor connected to said second input terminal b;

said second LC stage having a second inductor and a second capacitor, a first lead of said second inductor connected to said first lead of said first capacitor, a second lead of said second inductor connected to a first lead of said second capacitor, and a second lead of said second capacitor connected to said second lead of said first capacitor; and d. said switching frequency $f_s$ tuned to said second resonant frequency $f_2$.

2. The ballast of claim 1 wherein said second frequency $f_2$ is selected to be two to two and one-half percent higher in frequency than said first frequency $f_1$.

3. The ballast of claim 1 wherein said means for inverting said dc voltage supply $V_s$ comprises a half-bridge inverter.

4. The ballast of claim 3 wherein said half-bridge inverter comprises a third capacitor and a fourth capacitor, a first switching means, and a second switching means, a first lead of said third capacitor connected to a positive electrode of said dc supply voltage and a second lead of said third capacitor connected to a first lead of said fourth capacitor, a second lead of said fourth capacitor connected to a negative electrode of said dc supply voltage, said connection between said third capacitor and said fourth capacitor comprising said first input terminal a, said first switching means switchably permitting current flow from the positive electrode of said dc supply voltage to said second input terminal b, said second switching means switchably permitting current flow from said second input terminal b to the negative electrode of said dc supply voltage.

5. The ballast of claim 4 wherein said first switching means comprises a first field effect transistor (FET) having its drain lead connected to the positive terminal of said dc supply voltage and having its source lead connected to said second input terminal b; and wherein said second switching means comprises a second FET having its drain lead connected to said second input terminal b and having its source lead connected to said negative electrode of said dc supply voltage;

and wherein a first diode has its anode connected to said source lead of said first FET and said first diode has its cathode connected to the drain lead of said first FET, and wherein a second diode has its anode connected to said source lead of said second FET and said second diode has its cathode connected to the drain lead of said second FET.

6. The ballast of claim 1 further comprising a filament power supply, said filament power supply to provide a first filament voltage $V_{f1}$ across a first filament of a lamp for starting said lamp and to provide a second filament voltage $V_{f2}$ across said first filament for steady state operation of said lamp such that $V_{f2}$ is lower in magnitude than $V_{f1}$.

7. The ballast of claim 6 wherein said filament power supply derives its power from said second inductor.

8. The ballast of claim 7 wherein said second inductor is a primary winding of a transformer having both a primary winding and a secondary winding and wherein said filament power supply is said secondary winding of said transformer.

9. The ballast of claim 4 wherein said first switching means and said second switching means have adjustable switching frequency and wherein said lamp is dimmed or brightened by changing said switching frequency.

10. The ballast of claim 4 wherein said first switching means and said second switching means have adjustable switching frequency and wherein said lamp is dimmed or brightened by changing said switching frequency.

11. The ballast of claim 4 wherein said first switching means and said second switching means have adjustable switching frequency and wherein said lamp is dimmed or brightened by changing said switching frequency.

12. The ballast of claim 5 wherein said first switching means and said second switching means have adjustable switching frequency and wherein said lamp is dimmed or brightened by changing said switching frequency.

13. The ballast of claim 5 wherein said first switching means and said second switching means have adjustable switching frequency and wherein said lamp is dimmed or brightened by changing said switching frequency.

14. The ballast of claim 5 wherein said first switching means and said second switching means have adjustable switching frequency and wherein said lamp is dimmed or brightened by changing said switching frequency.

* * * * *